US005718152A

United States Patent [19]

Thudium et al.

[11] Patent Number: 5,718,152

[45] Date of Patent: Feb. 17, 1998

[54] PRESS WITH GRIPPING RAILS AND PRETENSIONING DEVICE

[75] Inventors: Karl Thudium, Waeschenbeuren; Andreas Dangelmayr, Ottenbach; Dieter Wolz, Heiningen, all of Germany

[73] Assignee: Schuler Pressen GmbH & Co., Germany

[21] Appl. No.: 504,808

[22] Filed: Jul. 20, 1995

[30] Foreign Application Priority Data

Jul. 20, 1994 [DE] Germany ..... 44 25 560.8

[51] Int. Cl.[6] ..... F16H 53/00; B21D 43/05

[52] U.S. Cl. ..... 74/567; 74/569

[58] Field of Search ..... 74/569, 567

[56] References Cited

U.S. PATENT DOCUMENTS

| | | | |
|---|---|---|---|
| 2,266,081 | 12/1941 | Rogers | 74/569 |
| 2,558,679 | 6/1951 | Gressel et al. | 74/569 X |
| 3,116,923 | 1/1964 | Gunther | 74/569 |
| 3,585,837 | 6/1971 | Bihler | 74/567 X |
| 5,127,252 | 7/1992 | Lange | 74/567 X |

FOREIGN PATENT DOCUMENTS

| | | | |
|---|---|---|---|
| 0394723 | 10/1990 | European Pat. Off. . | |
| 1101917 | 10/1955 | France | 74/569 |
| 21 12 590 | 10/1972 | Germany . | |
| 38 32 499 A1 | 3/1990 | Germany . | |

*Primary Examiner*—Charles A. Marmor
*Assistant Examiner*—Mary Ann Battista
*Attorney, Agent, or Firm*—Evenson, McKeown, Edwards & Lenahan, P.L.L.C.

[57] ABSTRACT

A press is provided with gripping rails for moving workpieces in work stations. The press is provided with a motor and a shaft moved thereby, on which shaft cams are mounted. Swing levers follow the shape of the cams, and connecting tabs direct the movements of swing levers toward driving movements of the gripping rails. At least two rollers are rotatably mounted on swing levers. The rollers run on the shaft cams. At least one of the two rollers is pressable with zero play against one of cams by a pretensioning device.

9 Claims, 3 Drawing Sheets

PRESS WITH GRIPPING RAILS AND PRETENSIONING DEVICE

BACKGROUND AND SUMMARY OF THE INVENTION

The present invention relates to press with gripping for shifting workpieces in work stations, and more particularly to a press comprising a movable shaft with shaft cams are mounted, swing levers configured and arranged to follow the shape of curves of respective ones of the shaft cams and, connecting tabs operatively associated with the swing levers to direct the movements of the swing levers in driving movements of the gripping rails, at least two rollers being rotatably mounted on the respective swing levers and arranged to run on respective ones of the shaft cams.

In order to operate presses as effectively as possible, a workpiece to be finished should pass through it at the highest speed possible. To permit this high speed operation, the workpiece transporting devices, which often are in the form of gripping rails, must be moved correspondingly quickly. Arbitrarily high speeds are not possible, however, because the workpiece transport devices are usually moved by cams, with levers abutting the cams and levers following cam contours. The resultant movement of the levers is then directed in the desired direction to receive or transport the workpiece by suitable devices.

A problem arises in this connection that if the rotational speed of the cams is too high, the levers abutting them no longer rest completely and/or permanently against the cams, but lift off the cams under the influence of the centrifugal and inertial forces that develop. Consequently, controlled workpiece transport within the press is no longer possible.

DE3832499 discloses a press provided with gripping rails and double cams. The contours of the double cams are followed by one lever. The problem arises, however, that because of the manufacturing tolerances of both the cams and the levers, a small amount of play is unavoidable when following the cams. This can lead to inaccuracies in the transport of workpieces between the individual press stations. In addition, at a relatively high rotational speed of the cams there is the risk that, as already mentioned, the lever no longer rests permanently against the double cam and follows it. As a result, problem-free transport of workpieces between the individual stations of a press is no longer ensured.

DE-OS2112590 discloses a press line in which individual elements of the press line can be traversed by conveyors located below the floor level. A swiveling lever provided with a pressure roller abuts against a cam. The lever is pressed by a pneumatic cylinder against the cam. The device does not serve to move workpieces in the machining stations of presses, but only to shift entire elements of a press line.

The present invention has, therefore, an object of providing a press with gripping rails for moving workpieces in machining stations to eliminate the above-mentioned disadvantages, especially to provide a press that operates economically and eliminates malfunctions in workpiece transport between the individual machining stations of a press.

This object has been achieved according to the present invention by using a pretensioning device to press one of two rollers with zero play against a cam. Thereby, any play between the swing lever and roller and the cams can be avoided, so that the entire workpiece transport device operates in an error-free manner.

By providing a pretensioning device that presses one of the two rollers against the cams, the cams can be operated at relatively high rotational speeds. Thus, the throughput of the press can be increased as a result and the press therefore operates more economically.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 4:
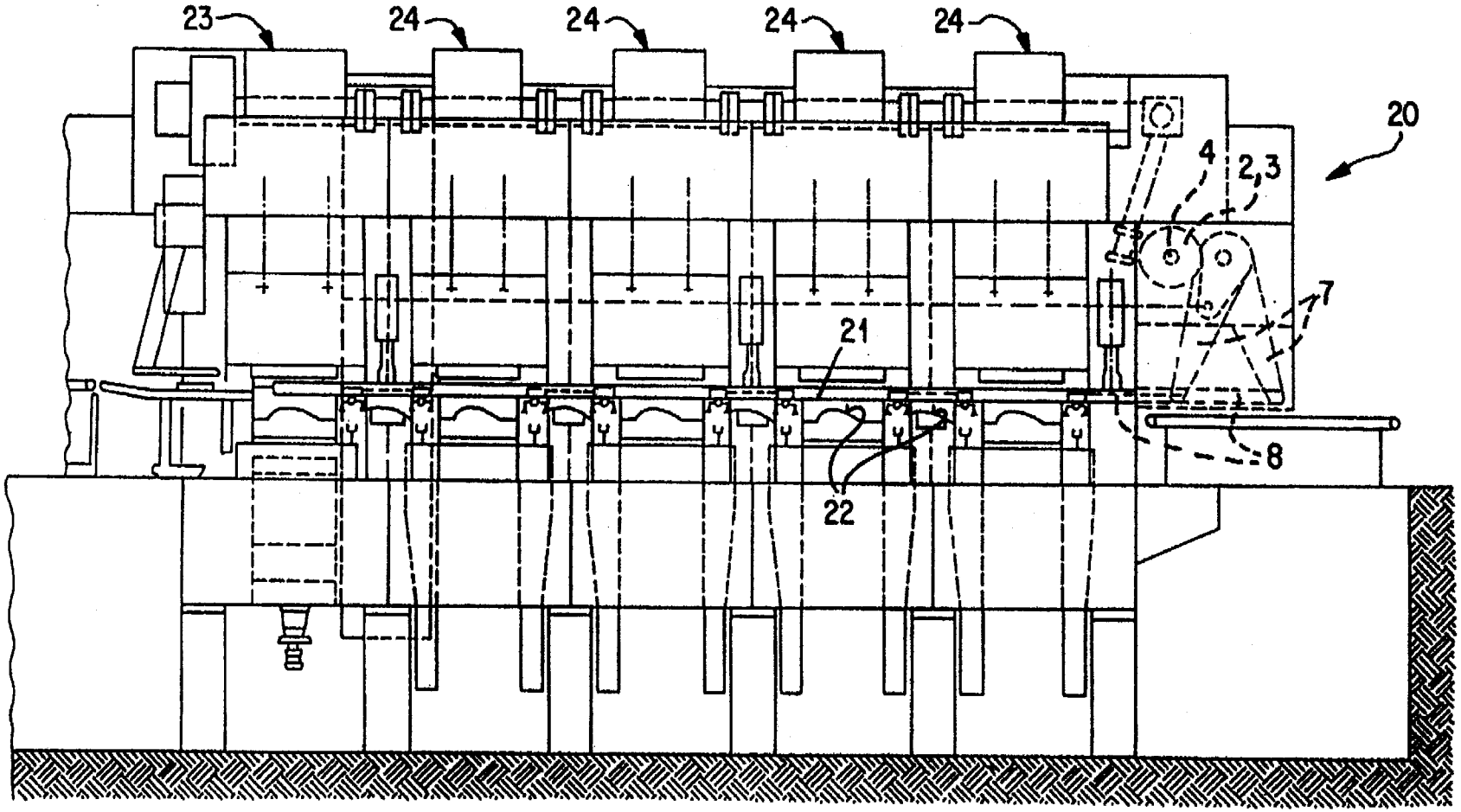
FIG. 4 is a front view of a conventional press installation utilizing the present invention shown in FIGS. 1–3.

FIG. 4 depicts a press installation 20 having a workpiece transport device such as gripping rails 21 and associated tools 22. A head press 23 such as a drawing press is followed by a series of transfer presses 24. A rod 8 is connected with the gripping rails 21 on each side of the press 20.

Figure 2:
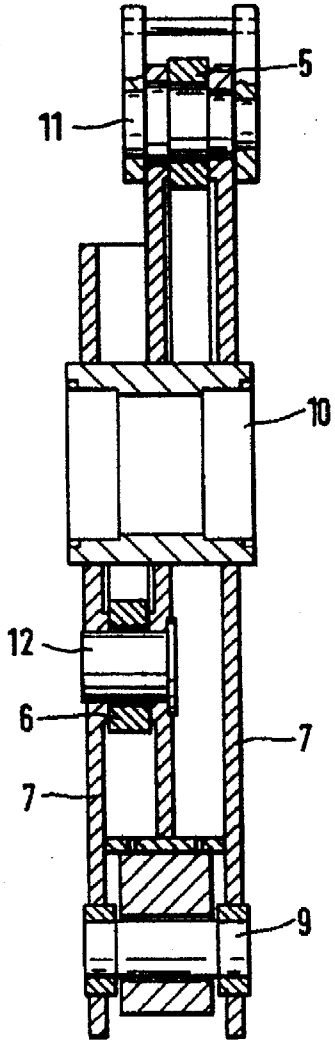
FIG. 2 is a side view of the swing lever shown in FIG. 1.
Figure 1:
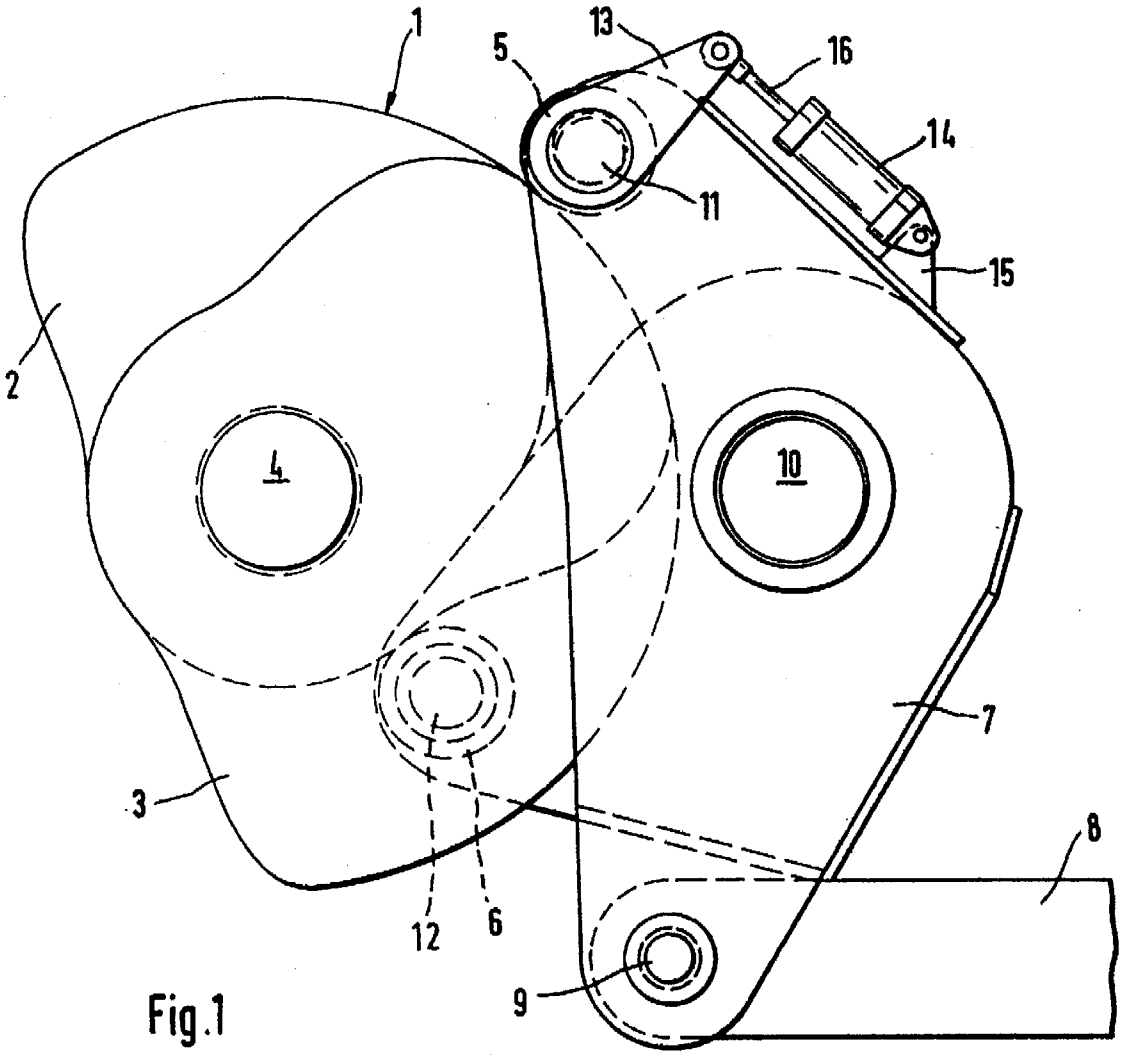
FIG. 1 is an elevational front view of a swing lever that follows a double cam in accordance with the present invention.

In FIGS. 1 and 2, a double cam 1 is shown with two single cams 2 and 3. Single cams 2, 3 are relatively fixedly disposed on a common shaft 4, so that they move in synchronization. Two rollers 5 and 6 are provided to follow the contours of double cam 1, said rollers abutting the respective single cams 2, 3. Rollers 5, 6 are connected by a swing lever 7 as well as the rod 8 with a workpiece transport device of the press. Such a workpiece transport device is shown in FIG. 2 of U.S. Pat. No. 5,012,665, the subject matter of which is incorporated by reference to show, inter alia, a press with gripping rails for moving workpieces in machining stations. The connection between swing lever 7 and rod 8 is made by a pivot 9.

Swing lever 7 itself is rotatably mounted at a point 10 so that the rotational axis of swing lever 7 runs parallel to the axial direction of shaft 4.

Rollers 5, 6 are each rotatably mounted on pins 11 and 12. The pin of roller 5 is an eccentric pin 11 and is connected by a connector 13 with a pretensioning device which, in the present embodiment, is in the form of a hydraulic cylinder 14. pretensioning device 14, i.e. the hydraulic cylinder, is permanently connected by a pedestal bearing 15 with swing lever 7. The underside of hydraulic cylinder 14, i.e. the side facing away from the piston rod 16 of hydraulic cylinder 14, is rotatably mounted on pedestal bearing 15.

The end of piston rod 16 facing away from hydraulic cylinder 14 is likewise provided with a pivot, so that the connection between connector 13 and piston rod 16 of hydraulic cylinder 14 is also made by a bearing that permits a pivoting motion of connector 13. For the sake of simplicity, the arrangement described for hydraulic cylinder 14 is shown only for roller 5. Of course, this arrangement can also be provided as described for roller 6.

When piston rod 16 of hydraulic cylinder 14 is pushed, because of the eccentric configuration of pin 11, roller 5 is brought closer to the single cam 3 of double cam 1. Thus, the play between roller 5 and single cam 3, and also between roller 6 and single cam 2 is eliminated. As a result, permanent contact between rollers 5, 6 and respective single cams 2, 3 and pretensioning of rollers 5, 6 against double cam 1 are achieved. Hence, the entire transfer system for transporting workpieces between the individual stations of a press can be operated in a reliable manner and with a relatively high rotational speed of double cam 1. Moreover, the economy of a press equipped with the device described can be increased.

In FIG. 2, the offset of rollers 5, 6 is more clearly seen. In addition, it can be seen there that swing lever 7 is hollow, so that the bearing locations for rollers 5, 6 as well as for pivot 10 of swing lever 7 can be provided in the cavities of swing lever 7.

Figure 3:
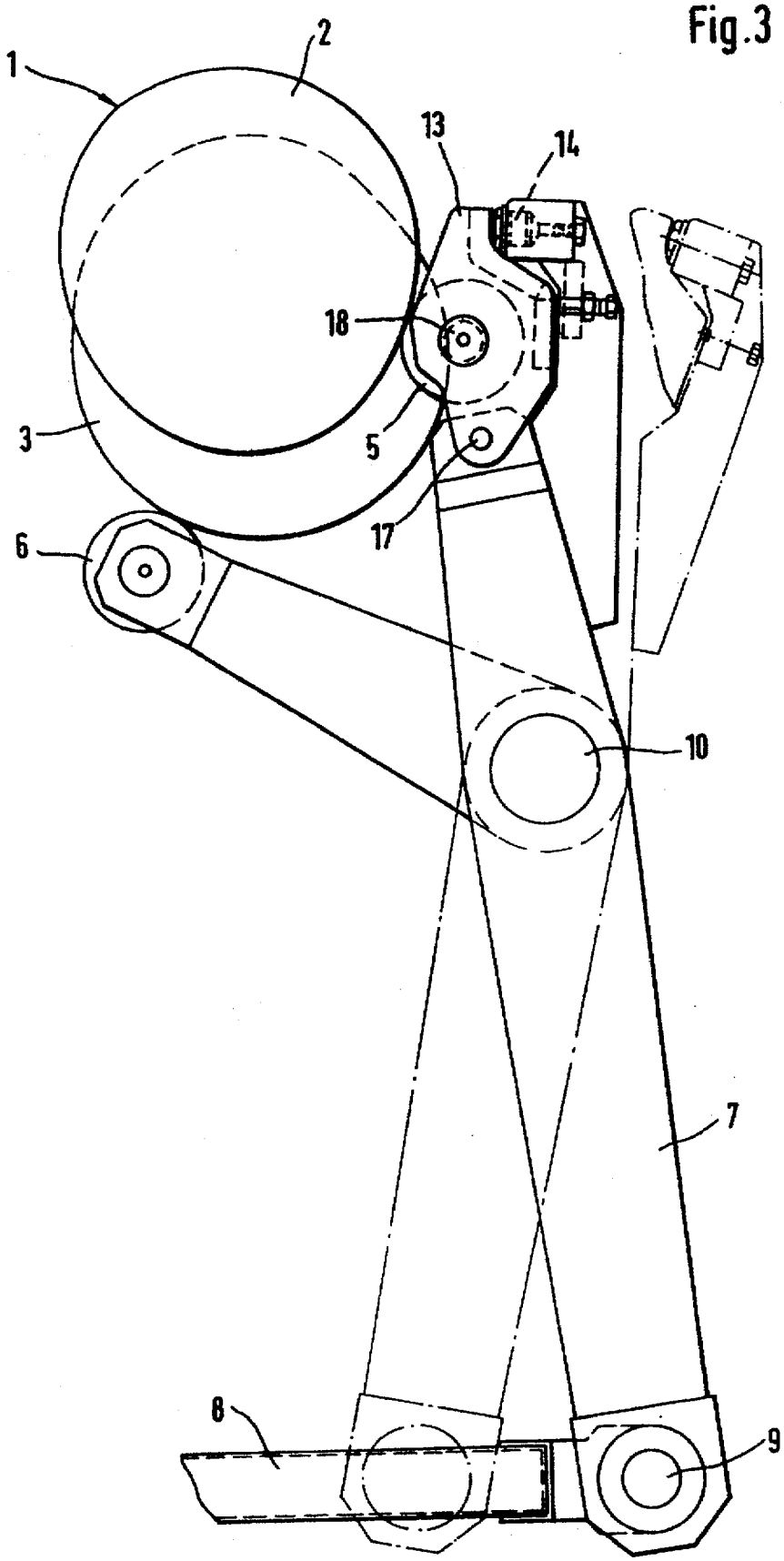
FIG. 3 is an elevational front view of a second embodiment of the present invention, similar to that shown in FIG. 1.

The second embodiment of the present invention shown in FIG. 3 use the same reference numerals as used in FIGS. 1 and 2 to describe similar parts with similar functions.

A double cam 1, which has two single cams 2, 3 mounted on a common shaft (not shown) is engaged by two rollers 5, 6, which follow the contour of double cam 1. Swing lever 7 is connected by a pivot 9 with a rod 8 to transfer the movements of swing lever 7 to the workpiece transport device of the press.

Swing lever 7 itself is rotatably mounted at a point 10. Rollers 5, 6 are rotatably mounted in connectors 13, with connector 13 being pivotable around an axis 17. The pivoting motion of connector 13 is achieved by activation of pressure unit 14 in the form of a hydraulic cylinder.

Because of the eccentric mounting of connector 13, (axis 17) rollers 5, 6 are pressed against the circumferential surfaces of double cam 1, avoiding any play. Rollers 5, 6 are not mounted on eccentric pins but on axis 18 with a circular cross sectional surface. The pressing movement, as already described, results from the eccentric mounting and/or pivoting around rotational axis 17 of connector 13. A second position of swing lever 7 following pivoting is indicated by the short and long dashed lines in FIG. 3. For reasons of clarity, the system shown in FIG. 3 is described for roller 5. Of course, however, it is to be understood that it is within the scope of the present invention also to provide the same arrangement for roller 6 or to provide the system described only on roller 6.

Pretensioning device 14 can also be made advantageously in the form of a pneumatic cylinder or a mechanical device instead of being a hydraulic cylinder. The important consideration is that a sufficiently great pressure be achieved with pretensioning device 14 to press rollers 5, 6 against the circumferential surfaces of double cam 1 with pretensioning and thus compensate for the play between double cam 1 and rollers 5, 6.

Although the invention has been described and illustrated in detail, it is to be clearly understood that the same is by way of illustration and example, and is not to be taken by way of limitation. The spirit and scope of the present invention are to be limited only by the terms of the appended claims.

What is claim is:

1. A press with gripping rails for moving workpieces in machining stations, comprising a movable shaft upon which shaft cams are mounted, a swing lever configured and arranged about an axis to follow the shape of curves of respective ones of the shaft cams for driving movements of the gripping rails, at least two rollers being rotatably mounted on the swing lever to run on respective ones of the shaft cams, one of the rollers being mounted on an eccentric pin and a pretensioning device being operatively connected between the swing lever and the eccentric pin, and arranged to be selectively actuated to press at least one of the rollers into pressing contact against one of the shaft cams to move the swing lever in a predetermined direction.

2. The press according to claim 1, wherein the pretensioning device is a hydraulic system.

3. The press according to claim 1, wherein the pretensioning device is a pneumatic system.

4. The press according to claim 1, wherein a connector ms pivotally mounted eccentrically with respect to a pivot thereof, with one of the at least two rollers being pivotable in a direction of the shaft cams when the pretensioning device is activated.

5. The press according to claim 4, wherein the pretensioning device is a hydraulic system.

6. The press according to claim 4, wherein the pretensioning device is a pneumatic system.

7. A press with gripping rails for moving workpieces in machining stations, comprising a movable shaft upon which shaft cams are mounted, a swing lever configured and arranged about an axis to follow the shape of curves of respective ones of the shaft cams for driving movements of the gripping rails, at least two rollers being rotatably mounted on the swing lever and arranged to run on respective ones of the shaft cams, and a pretensioning device operatively configured to be selectively actuated to press at least one of the rollers into pressing contact against one of the shaft cams to move the swing lever in a predetermined direction, wherein one of the at least two rollers is mounted on a rotatably mounted eccentric pin and is provided on a connector, and with the one of the least two rollers arranged to be movable in a direction of one of the shaft cams the pretensioning device is activated and another of the at least two rollers abuts another of the shaft cams.

8. The press according to claim 7, wherein the pretensioning device is a hydraulic system.

9. The press according to claim 7, wherein the pretensioning device is a pneumatic system.

* * * * *